US009628205B2

(12) United States Patent
Lim et al.

(10) Patent No.: US 9,628,205 B2
(45) Date of Patent: Apr. 18, 2017

(54) METHOD AND APPARATUS FOR TRANSMITTING AND RECEIVING BROADCAST SERVICE DATA IN A BROADCASTING COMMUNICATION SYSTEM, METHOD FOR CONFIGURING THE BROADCAST SERVICE DATA, AND FRAME INCLUDING THE BROADCAST SERVICE DATA

(75) Inventors: Yeon-Ju Lim, Seoul (KR); Hwan-Joon Kwon, Suwon-si (KR); Hak-Ju Lee, Incheon (KR); Jae-Yoel Kim, Suwon-si (KR); Sung-Ryul Yun, Suwon-si (KR); Hong-Sil Jeong, Seoul (KR); Seho Myung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1574 days.

(21) Appl. No.: 12/360,959

(22) Filed: Jan. 28, 2009

(65) Prior Publication Data

US 2009/0190567 A1 Jul. 30, 2009

(30) Foreign Application Priority Data

Jan. 28, 2008 (KR) ..... 10-2008-0008800
Feb. 4, 2008 (KR) ..... 10-2008-0011005

(51) Int. Cl.
*H04H 20/42* (2008.01)
*H04H 20/30* (2008.01)

(52) U.S. Cl.
CPC ..... *H04H 20/42* (2013.01); *H04H 20/30* (2013.01)

(58) Field of Classification Search
USPC ..... 370/389, 395.4, 436, 458, 462, 474
See application file for complete search history.

(56) References Cited

U.S. PATENT DOCUMENTS

| | | | | |
|---|---|---|---|---|
| 6,144,707 | A * | 11/2000 | Yoshida et al. | 375/316 |
| 7,130,313 | B2 | 10/2006 | Pekonen | |
| 2003/0152107 | A1 | 8/2003 | Pekonen | |
| 2006/0245516 | A1 | 11/2006 | Simon | |
| 2006/0259433 | A1 | 11/2006 | Lahtinen et al. | |
| 2007/0076587 | A1 | 4/2007 | Kwon et al. | |

(Continued)

FOREIGN PATENT DOCUMENTS

| | | |
|---|---|---|
| EP | 1 793 590 A1 | 6/2007 |
| GB | 2 408 433 A | 5/2005 |
| WO | 03/001685 A2 | 1/2003 |

(Continued)

OTHER PUBLICATIONS

Standard ISO 2382-1:1993.

(Continued)

*Primary Examiner* — Alex Skripnikov
(74) *Attorney, Agent, or Firm* — Jefferson IP Law, LLP

(57) ABSTRACT

An apparatus and method for configuring a broadcast service data in a digital broadcasting communication system are provided. The method includes mapping a first zone, corresponding to broadcast service data of a first type, and a second zone, corresponding to broadcast service data of a second type, in a frame individually. Preferably, the broadcast service data included in the first zone and the second zone is sliced into sub-slices according to a different number of service slicings for each zone.

40 Claims, 7 Drawing Sheets

(56) References Cited

U.S. PATENT DOCUMENTS

2011/0188501 A1* 8/2011 Kim et al. ..... 370/390

FOREIGN PATENT DOCUMENTS

WO 2006/066617 A1 6/2006
WO 2006/110456 A1 10/2006

OTHER PUBLICATIONS

Nevdiaev L.M. English—Russian explanatory dictionary, Moscow 2002, p. 165.
Digital Video Broadcasting (DVB); System Specifications for Satellite services to Handheld devices(SH) below 3GHz, ETSI TS 102 585, ETSI Standards, Sophia Antipolis Cedex, France, V1.1.1.

* cited by examiner

METHOD AND APPARATUS FOR TRANSMITTING AND RECEIVING BROADCAST SERVICE DATA IN A BROADCASTING COMMUNICATION SYSTEM, METHOD FOR CONFIGURING THE BROADCAST SERVICE DATA, AND FRAME INCLUDING THE BROADCAST SERVICE DATA

PRIORITIES

This application claims the benefit under 35 U.S.C. §119 (a) of a Korean patent application filed in the Korean Intellectual Property Office on Jan. 28, 2008 and assigned Ser. No. 10-2008-0008800, and of a Korean patent application filed in the Korean Intellectual Property Office on Feb. 4, 2008 and assigned Ser. No. 10-2008-0011005, the entire disclosures of both of which are hereby incorporated by reference.

BACKGROUND OF THE INVENTION

1. Field of the Invention

The present invention relates to a broadcasting communication system for transmitting and receiving broadcast service data using one Radio Frequency (RF). More particularly, the present invention relates to a method and apparatus for transmitting and receiving a frame composed of a plurality of broadcast services in a broadcasting communication system, a method for configuring the frame, and the frame thereof.

2. Description of the Related Art

In the 21st century's information society, broadcasting communication services are entering the era of the digital, multi-channel, broadband and high-quality broadcasting and communication. Particularly, with the recent increasing popularization of high-definition digital television, Portable Multimedia Player (PMP) and portable broadcasting devices, digital broadcasting services also increasingly need to support various reception schemes.

To meet the needs, Digital Video Broadcasting-Terrestrial 2 (DVB-T2), which is the European 2nd generation terrestrial digital broadcasting standard, is pushing ahead with standardization for each of three reception schemes. The first is a reception scheme of recycling the conventional household digital reception antennas. The second is a reception scheme using multiple antennas for capacity improvement. The third is a reception scheme for portable mobile terminals. Compared with DVB-Terrestrial/Handheld (DVB-T/H), which is the $1^{st}$ generation terrestrial digital broadcasting standard and considers only two reception schemes of a fixed reception scheme and a mobile reception scheme, the DVB-T2 additionally considers the reception scheme of using multiple antennas. The DVB-T2 standard does this by considering, as its main standardization work, an operation of changing a physical layer structure and control information based on the physical layer structure.

In the physical layer structure, a control channel refers to a channel that transmits a control message for a transmission scheme in the physical layer. If the basic unit of a transmission signal is defined as a frame, one frame can be composed of a plurality of services and include a service index, location information, modulation scheme/coding rate, and cell identifier (ID) for each service. The control channel can be transmitted independently of a data channel in every frame, since the service configuration and its associated information can vary frame by frame. Since demodulation for the control channel should be performed first in order for a terminal to receive a service channel, the control channel should be situated first in the frame. Following the control channel is a plurality of services. In the following description, the control channel in the broadcasting system will be referred to as a P2 preamble.

FIG. 1 is a diagram illustrating a scheme of transmitting and receiving broadcast services in a Fixed Frequency (FF) mode indicating the conventional $1^{st}$ generation broadcasting system.

Referring to FIG. 1, a transmitter 102 transmits different broadcast services at their associated multiple RFs, and a receiver 104 receives its desired service by tuning to an RF on which the desired service is transmitted. For example, when the receiver 104 wants to receive a service 1, the receiver 104 tunes its reception module to RF1, acquires information such as location information and modulation/coding scheme for the service 1 through a P2 preamble, and then demodulates the service 1.

As can be seen in FIG. 1, as regards a plurality of services constituting one frame in an arbitrary RF channel, each service's length in the time domain is different since each service has a different transmission data rate. In this case, a service having a high transmission data rate can be considered to undergo sufficient time diversity since it has a long transmission period in the time domain, whereas a service having a low transmission data rate cannot be considered to obtain a sufficient diversity gain because it has a very short transmission period. In particular, as the broadcasting system is very susceptible to impulse noises, multiple Orthogonal Frequency Division Multiplexing (OFDM) symbols, rather than one OFDM symbol, are apt to be damaged in the time domain. Since the service having the low transmission data rate is composed of fewer symbols, most data corresponding to the service may be damaged when an impulse noise occurs, causing a possible case in which the corresponding service cannot be demodulated at all in the frame.

Therefore, in order to allow a transmission service to obtain a time diversity gain, each service can be sliced into more than two small services in the time domain. The sliced sub-services having a small size will be referred to herein as sub-slices. When such service slicing is performed, an increase in the number of service slicings causes an increase in diversity gain that can be obtained in the time domain. Generally, up to several hundred service slicings can be considered to acquire a very high diversity gain.

In this specification, with reference to FIGS. 2A and 2B, a description will be made of a method for configuring a frame using the service slicing in a conventional broadcasting communication system.

FIG. 2A is a diagram illustrating a conventional frame structure in which 4 logical services are arranged.

Referring to FIG. 2A, a conventional frame structure can be seen in which 4 logical services are disposed. When their service indexes are given as 1, 2, 3 and 4, the 4 services can be arranged in the frame in an arbitrary order. In the example of FIG. 2A, the services are arranged in ascending order of the index value. Further, time periods of the services are denoted by $T_1$, $T_2$, $T_3$, and $T_4$, respectively.

In order to physically map the services, which are logically configured in one frame, to a frame through service slicing, each service should undergo service slicing. For example, if each service is divided into 4 sub-slices, a transmission period for each service in the time domain occupied by the corresponding service should be divided by 4 as shown in FIG. 2A. Therefore, the services each have 4 sub-slices having sub-slice periods $T_1/4$, $T_2/4$, $T_3/4$, and $T_4/4$. As a result, a total of 16 sub-slices are generated for the 4 services that should be transmitted over the frame.

FIG. 2B is a diagram illustrating a conventional frame in which services are physically arranged, each of which consists of sub-slices by service slicing.

Referring to FIG. 2B, 4 sub-slices constituting one service should be spaced as far away as possible to achieve time diversity. Since the services each are configured with the same number of sub-slices, the distance between sub-slices belonging to the same service is constant. That is to say, since each service is sliced into 4 sub-slices, an interval, or distance, between sub-slices belonging to the same service becomes a value obtained by dividing the total frame period $T_F$ by 4, so the sub-slices have a uniform interval. For example, FIG. 2B shows an interval $T_F/4$ between 4 sub-slices 1-1, 1-2, 1-3 and 1-4 (where former numerals represent service indexes while latter numerals represent sub-slice indexes) belonging to the first service. Since the distance between sub-slices belonging to the same service is equal, the order of sub-slices for each service, arranged in the first $T_F/4$ period, is equally repeated every $T_F/4$.

As described above, one purpose of using the method for mapping services in a frame based on the service slicing is for obtaining diversity gain for the services transmitted in one frame including a service having a low transmission data rate.

Since a corresponding service in one frame is composed of multiple sub-slices, a receiver needs to perform demodulation as many times as the number of sub-slices in order to receive a target service it should receive. In other words, assuming that each service consists of 4 sub-slices as shown in FIGS. 2A and 2B, because a receiving terminal should perform demodulation 4 times for a one-frame time period, switching between demodulation and non-demodulation happens four times.

However, when the reception operation is considered in a mobile terminal as opposed to a fixed terminal, an operation of performing demodulation for a sub-slice period and not performing demodulation until the next sub-slice is received, is repeated as many times as the number of sub-slices. Such an operation increases the power that the mobile terminal should consume, and causes a heavy burden in terms of power consumption. That is, from the standpoint of the mobile terminal, the service slicing operation that is used to obtain a time diversity gain requires heavy power consumption for the battery, causing a power problem.

Therefore, in considering the fixed terminal, it is preferable to perform service slicing as many times as possible. Conversely, for the mobile terminal, it is preferable to continuously transmit one service in the time domain without service slicing (i.e. the number of sub-slices corresponding to one service is one), or to carry out service slicing as few times as possible.

However, when services in a frame are physically mapped using various types of the number of service slicings (e.g. a service for one fixed terminal is composed of 100 sub-slices while a service for one mobile terminal consists of 4 sub-slices) in order to consider both the fixed terminal and the mobile terminal, the interval between sub-slices belonging to the same service may not be constant.

This means that for all sub-slices for the fixed and mobile terminals, a base station should signal all their location information in a frame. For instance, assume that an overhead of 20 bits is needed to indicate location information in a frame, 4 services for a fixed terminal and 1 service for a mobile terminal are transmitted through one frame, a service for the fixed terminal is mapped to 4 sub-slices, and a service for the mobile terminal is mapped to one sub-slice. In this case, as a total of 17 sub-slices exist in the frame, signaling for the total of 17 locations requires 20*17=340 bits, causing an increase in the signaling overhead.

Accordingly, there is a need for an apparatus and method for improving reception performance of a broadcast service.

SUMMARY OF THE INVENTION

An aspect of the present invention is to address at least the above-mentioned problems and/or disadvantages and to provide at least the advantages described below. Accordingly, an aspect of the present invention is to provide a method and apparatus capable of improving reception performance of a broadcast service being transmitted to fixed and mobile terminals in a broadcasting communication system.

Another aspect of the present invention is to provide a method and apparatus for transmitting and receiving broadcast service data for a fixed terminal and broadcast service data for a mobile terminal in a broadcasting communication system.

Still another aspect of the present invention is to provide a frame configuring method for physically mapping a plurality of services in a frame by service slicing in a broadcasting communication system, and a frame thereof According to one aspect of the present invention, a method for configuring a broadcast service data in a digital broadcasting communication system is provided. The method includes mapping a first zone, corresponding to broadcast service data of a first type, and a second zone, corresponding to broadcast service data of a second type, in a frame individually. Preferably, the broadcast service data included in the first zone and the second zone is sliced into sub-slices according to a different number of service slicings for each zone.

According to another aspect of the present invention, a frame including broadcast service data in a digital broadcasting communication system is provided. The frame includes a first zone, corresponding to broadcast service data of a first type, and a second zone, corresponding to broadcast service data of a second type, and the first zone and the second zone are mapped in the frame individually. Preferably, the broadcast service data included in the first zone and the second zone is sliced into sub-slices according to a different number of service slicings for each zone.

According to still another aspect of the present invention, a method for transmitting broadcast service data in a digital broadcasting communication system is provided. The method includes mapping a first zone, corresponding to broadcast service data of a first type, and a second zone, corresponding to broadcast service data of a second type, in a frame individually and transmitting the frame. Preferably, the broadcast service data included in the first zone and the second zone is sliced into sub-slices according to a different number of service slicings for each zone.

According to yet another aspect of the present invention, a method for receiving broadcast service data in a digital broadcasting communication system is provided. The method includes receiving a frame in which the broadcast service data is included, wherein a first zone, corresponding to broadcast service data of a first type, and a second zone, corresponding to broadcast service data of a second type, are mapped in the frame individually. Preferably, the broadcast service data included in the first zone and the second zone is sliced into sub-slices according to a different number of service slicings for each zone.

According to still another aspect of the present invention, an apparatus for transmitting broadcast service data in a digital broadcasting communication system is provided. The apparatus includes a frame configurator for configuring a frame by mapping a first zone, corresponding to broadcast service data of a first type, and a second zone, corresponding to broadcast service data of a second type, in the frame individually and a frame transmitter for transmitting the configured frame. Preferably, the broadcast service data included in the first zone and the second zone is sliced into sub-slices according to a different number of service slicings for each zone.

According to yet another aspect of the present invention, an apparatus for receiving broadcast service data in a digital broadcasting communication system is provided. The apparatus includes a receiver for receiving a frame including the broadcast service data, and for demodulating the received frame, wherein a first zone, corresponding to broadcast service data of a first type, and a second zone, corresponding to broadcast service data of a second type, are mapped in the frame individually. Preferably, the broadcast service data included in the first zone and the second zone is sliced into sub-slices according to a different number of service slicings for each zone.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings in which.

Throughout the drawings, it should be noted that like reference numbers are used to depict the same or similar elements, features and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
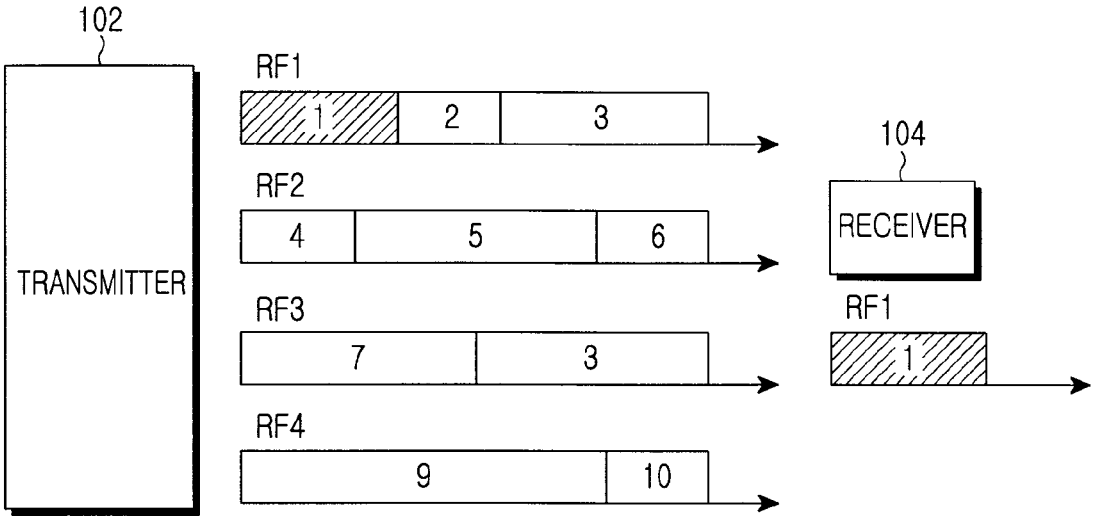
FIG. 1 (CONVENTIONAL ART)
FIG. 1 is a diagram illustrating a scheme of transmitting and receiving broadcast services in a Fixed Frequency (FF) mode indicating the conventional $1^{st}$ generation broadcasting system.
Figure 2A:
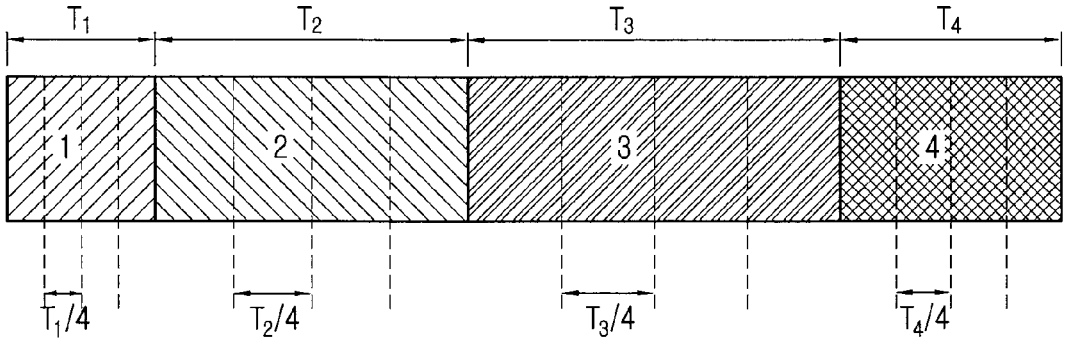
FIG.2A (CONVENTIONAL ART)
FIG. 2A is a diagram illustrating a conventional method for logically configuring a frame using service slicing in a broadcasting communication system.
Figure 2B:
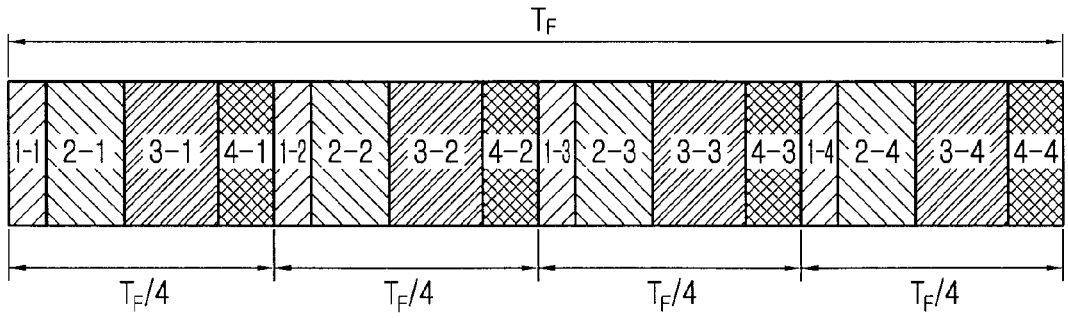
FIG.2B (CONVENTIONAL ART)
FIG. 2B is a diagram illustrating a conventional method for physically configuring a frame using service slicing in a broadcasting communication system.
Figure 3A:
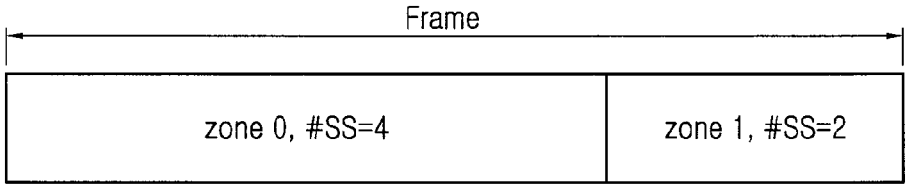
FIG. 3A is a diagram illustrating a method for logically configuring a frame using a plurality of zones based on service slicing in a broadcasting communication system according to an exemplary embodiment of the present invention.
Figure 3B:
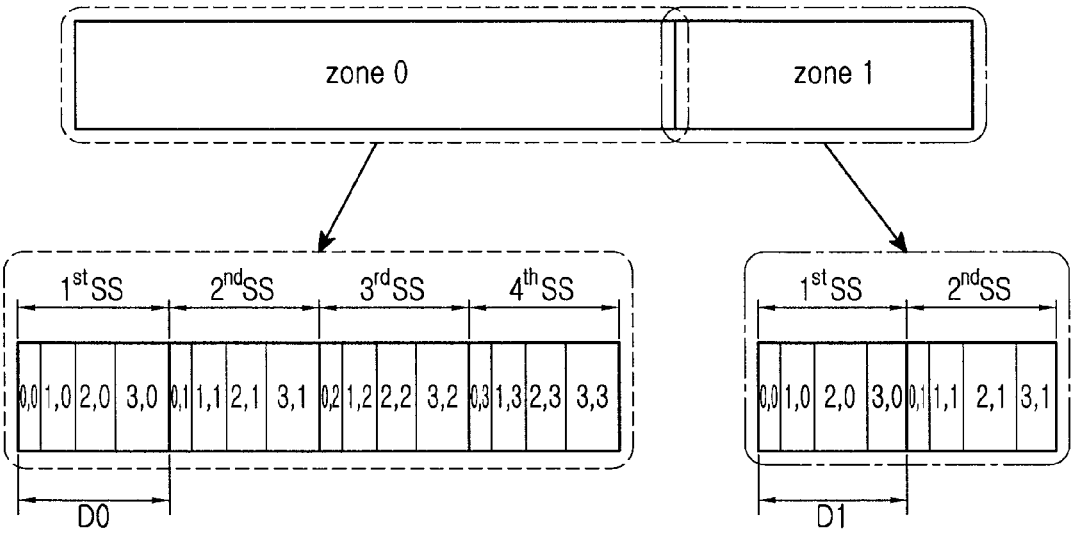
FIG. 3B is a diagram illustrating a method for configuring a frame by a TDM scheme using a plurality of zones based on service slicing in a broadcasting communication system according to an exemplary embodiment of the present invention.
Figure 3C:
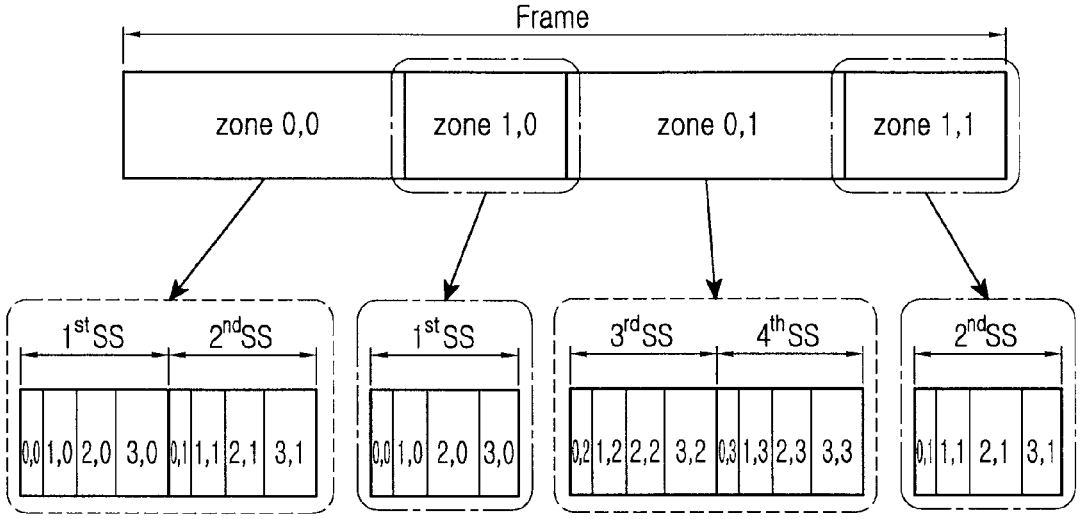
FIG. 3C is a diagram illustrating a method for configuring a frame by a diversity scheme using a plurality of zones based on service slicing in a broadcasting communication system according to an exemplary embodiment of the present invention.

FIGS. 3A to 3C are diagrams illustrating a method for configuring a frame using a plurality of zones based on service slicing in a broadcasting communication system according to an exemplary embodiment of the present invention.

Referring to FIG. 3A, as an example, 2 zones are logically disposed in a frame. The number of services allocated to one zone can be different from the number of services allocated to other zone. The services included in each zone should be sliced according to the number of service slicings for the corresponding zone. It is shown in FIG. 3A that the number of sub-slices is represented by #SS. Accordingly, each service included in the first zone should be divided into 4 sub-slices through 4 service slicings, while each service in the second zone should be divided into 2 sub-slices by undergoing service slicing 2 times.

Although a small number of service slicings is considered in an exemplary embodiment of the present invention for convenience of explanation, multiple zones allocated to one frame are actually aimed at simultaneous data transmission to the fixed and mobile terminals. Accordingly, up to several hundred service slicings can be used in a zone for the fixed terminal, and the small number of 2 or 4 service slicings can be used in a zone for the mobile terminal. In this case, in order for all services allocated to the individual zones to be sliced according to the number of service slicings for the corresponding zones and transmitted with a correct number of sub-slices in one frame, the number of service slicings of the individual zones should be determined depending on the corresponding zones. For example, if two zones exist in one frame and the first zone has the number, 36, of service slicings, the remaining second zone is allowed to use a number which is a divisor of 36, rather than using the arbitrary number of service slicings. That is, the second zone can use the number of service slicings, which corresponds to one of the numbers 1, 2, 3, 4, 6, 9, 12, 18 and 36.

FIGS. 3B and 3C are diagrams illustrating a frame in which zones are physically arranged, each of which is formed according to the number of service slicings, according to an exemplary embodiment of the present invention.

Referring to FIGS. 3B and 3C, two possible schemes can be seen in which two zones defined in one frame are physically mapped in the frame.

First, FIG. 3B represents a Time Division Multiplexing (TDM) scheme as the first zone mapping scheme, in which one zone is continuously allocated in the time domain. That is, FIG. 3B illustrates an exemplary method of mapping zones in a frame using a localized-TDM diversity scheme. As in FIG. 3A where multiple zones are logically allocated in one frame, each zone is physically mapped in the frame. For example, as can be seen in FIG. 3A, assume that 4 services exist in a zone 0, each service is defined to consist of 4 sub-slices, and similarly, in a zone 1 are defined 4 services to undergo 2 service slicings. The structure of 4 services allocated in the first zone is shown by the first dotted-line block. In each dotted-line block, each sub-slice is represented by (x,y), where x denotes a service index and y denotes a sub-slice index. For instance, (1,0) represents a first sub-slice of a second service, and indicates a sub-slice 0 of a service 1.

In order to obtain the maximum time diversity gain in the corresponding zone, an interval between sub-slices belonging to the same broadcast service should be as long as possible in each zone. To this end, for the zone 0, each service is divided into a total of 4 sub-slice groups since the number of service slicings is four, and each sub-slice group is adapted to consist of sub-slices corresponding to four services. That is, it can be noted that sub-slice groups (0,0), (1,0), (2,0) and (3,0), which are groups of the first sub-slices for each service, are first mapped, the second and third sub-slice groups are next mapped, and finally, sub-slice groups (0,3), (1,3), (2,3) and (3,3), which are composed of the fourth sub-slices for each service, are mapped. Therefore, as can be understood from FIG. 3B, an interval D0 between sub-slices belonging to the same service in the zone 0 becomes a length determined by dividing the size of the zone 0 by the corresponding number of service slicings.

Meanwhile, in a zone 1 indicating the second zone, each service is sliced into 2 sub-slices, and using the dotted-line block for the zone 1, a description will be made as to how more than one service allocated to the zone 1 is physically mapped. Since 4 services are configured in the zone 1 and the number of service slicings is 2, each service allocated in the zone 1 is divided into 2 sub-slices. As a result, sub-slice groups (0,0), (1,0), (2,0) and (3,0), which are groups of the first sub-slices of each service, and sub-slice groups (0,1), (1,1), (2,1) and (3,1), which are groups of the second sub-slices of each service, are generated, and a total of 8 sub-slices are mapped in the zone 1 in order of (0,0), (1,0), (2,0), (3,0), (0,1), (1,1), (2,1), (3,1). Therefore, an interval D1 between sub-slices belonging to the same service in the zone 1 becomes a length determined by dividing the size of the zone 1 by the corresponding number of service slicings.

FIG. 3C illustrates a diversity scheme as the second zone mapping scheme, in which one zone is scattered on the time domain in a distributed manner. The multiple zones which are logically allocated in the frame of FIG. 3A are physically mapped in the frame in such a manner that they are distributed in small-sized sub-zones as shown in FIG. 3C. Each sub-zone is represented by (x,y), where x denotes a zone index and y denotes a sub-zone index. Thus, when the first zone, or the zone 0, is divided into two sub-zones, the corresponding zone is composed of sub-zones. In this example, the corresponding zone is composed of sub-zones (0,0) and (0,1).

A sub-zone arrangement pattern, in which two zones are physically mapped in one frame, is determined by the number of service slicings for each zone and the number of services included in each zone. For instance, assuming that each zone is composed of 4 services, the number of service slicings for the zone 0 is 4, and the number of service slicings for the zone 1 is 2 as illustrated in FIG. 3A, when determination is made sub-slice by sub-slice, a total of 16 sub-slices are generated in the zone 0 and a total of 8 sub-slices are generated in the zone 1. When the total number of sub-slices per zone is divisible by a multiple of the number of services for each zone, the minimum common number (here, 1 is excluded) for the corresponding quotients can be determined as the number of sub-zones.

For example, since the zone 0 transmits 4 services, the number by which the total number, 16, of sub-slices is divisible becomes 4, 8 and 16 (multiples of the number of services), and their quotients become 4, 2 and 1, respectively. Meanwhile, since the zone 1 transmits 4 services, the number by which the total number, 8, of sub-slices is divisible becomes 4 and 8, and their quotients become 2 and 1, respectively. Hence, the minimum common number (except for 1), which satisfies the above condition for both of the two zones, becomes 2. This result indicates that each zone must be divided into two sub-zones.

In FIG. 3C, two zones each are divided into two sub-zones, so that a total of 4 sub-zones are arranged. In other words, two zones are alternately repeated in order of sub-zone (0,0), sub-zone (1,0), sub-zone (0,1) and sub-zone (1,1), and mapped in the frame as shown in FIG. 3C. Also, the size of the corresponding zone is determined by adding two sub-zones belonging to each zone.

To be more specific, as regards, for example, the zone 0, since 4 services each consist of 4 sub-slices per service and the corresponding zone is composed of two sub-zones, the first sub-zone transmits the first and second sub-slice groups and the second sub-zone transmits the third and fourth sub-slice groups. That is to say, a total of 8 sub-slices including the first 4 sub-slices of each service and the second 4 sub-slices of each service are transmitted through the first sub-zone (0,0) of the zone 0, and a total of 8 sub-slices including the remaining third and fourth sub-slices of each service are mapped in the second sub-zone (0,1) of the zone 0 and then transmitted. Meanwhile, it can be noted that for the zone 1, a sub-slice group consisting of the first sub-slices for each service among a total of 8 sub-slices is mapped in the first sub-zone (1,0) of the zone 1.

For reference, in the conventional service slicing-based frame configuring scheme, since the number of sub-slices per service, and a start point start_(x,0) (e.g. sub-slice 0 of service x) and a length length_(x,0) of the first sub-slice of each service are considered as scheduling information, once a start point start_0 of the first sub-slice of a target service and an interval D between sub-slices belonging to the same service are known, locations of the remaining sub-slices can be automatically determined. In this case, if each service is composed of, for example, 4 sub-slices, the interval D between sub-slices belonging to the same service becomes a value determined by dividing the total frame length by the number of service slicings. Therefore, locations of the remaining 3 sub-slices become start_(x,0)+D, start_(x,0)+D*2, and start_(x,0)+D*3, respectively. The frame length can be determined in units of sub-carriers of OFDM symbols. For example, if one frame is composed of 100 symbols and each OFDM symbol consists of 6000 sub-carriers, a length of the corresponding frame becomes 6000*100.

In the service slicing-based frame configuring scheme according to an exemplary embodiment of the present invention, a terminal should acquire additional scheduling information for a corresponding target service to receive its desired target service. As the corresponding scheduling information, the terminal should know the size of each zone, the number of service slicings (i.e. the number of sub-slices per service) for each zone and the number of services included in each zone. That is, if two zones are defined, a total of 6 pieces of scheduling information are needed, including a size SIZE_Z0 of the zone 0, a size SIZE_Z1 of the zone 1, the number NUM_SUB-SLICE_SERVICE_Z0 of sub-slices per service for the zone 0, the number NUM_SUB-SLICE_SERVICE_Z1 of sub-slices per service for the zone 1, the number NUM_SERVICE_Z0 of services for the zone 0, and the number NUM_SERVICE_Z1 of services for the zone 1.

When the number NUM_SERVICE_Z0 of services for the zone 0 is known, the number NUM_SERVICE_Z1 of services for the zone 1 is determined by subtracting NUM_SERVICE_Z0 from the total number of services. For example, assuming that 20 services are transmitted through the corresponding frame, when service indexes for the 20 services are listed in order of size to avoid occurrence of additional overhead, if first 15 services are included in the first zone, the remaining 5 services will be automatically included in the second zone.

A length determined by adding lengths length_(x,0) of the first sub-slices of each service included in the zone 0 becomes a length of one sub-slice group, and all sub-slice groups, the number of which corresponds to the number NUM_SUB-SLICE_SLICE_Z0 of sub-slices per service, have the same length. For example, if the zone 0 has 4 services and 4 sub-slices per service, a length of the first sub-slice group becomes a length length_(0,0)+length_(1,0)+length_(2,0)+length_(3,0) determined by adding lengths of the sub-slices of the 4 services. Since the number of sub-slice groups becomes the number NUM_SUB-SLICE_SLICE_Z0 of sub-slices per service, the size SIZE_Z0 of the zone 0 becomes (sub-slice group length) *NUM_SUB-SLICE_SLICE_Z0.

In other words, when the number NUM_SERVICE_Z0 of services for the zone 0 and the number NUM_SUB-SLICE_SLICE_Z0 of sub-slices per service for the zone 0 are known, the size SIZE_Z0 of the zone 0 is determined. In addition, the size SIZE_Z1 of the zone 1 is determined by subtracting the size SIZE_Z0 of the zone 0 from the total frame size.

As a result, when the number NUM_SERVICE_Z0 of services for the zone 0, the number NUM_SUB-SLICE_SERVICE_Z0 of sub-slices per service for the zone 0, and the number NUM_SUB-SLICE_SLICE_Z1 of sub-slices per service for the zone 1 are known, the terminal can acquire all 6 pieces of scheduling information that it additionally requires in receiving the target service.

In the diversity scheme illustrated in FIG. 3C, though the zones are divided into the same number of sub-zones and mapped for the frame period in the distributed manner, the zones may consist of a different number of sub-zones.

Figure 4:
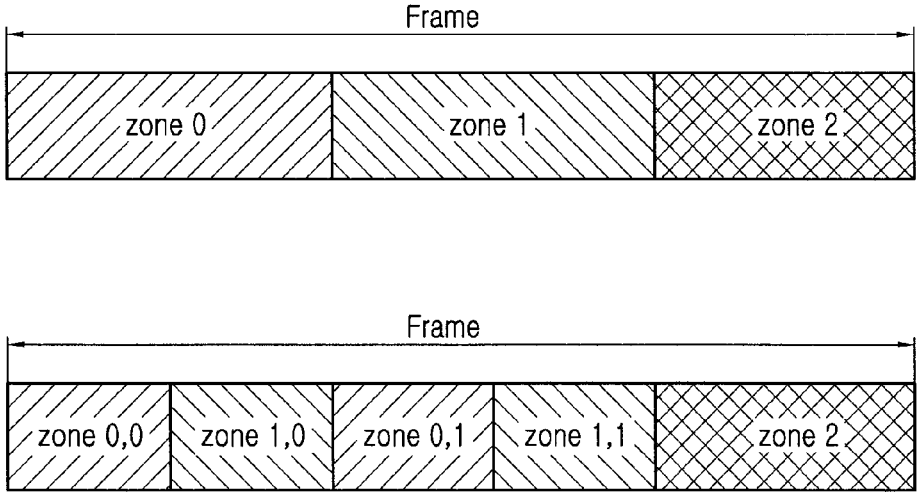
FIG. 4 is a diagram illustrating an example where each zone has a different number of sub-zones in zone mapping based on the diversity scheme according to an exemplary embodiment of the present invention.

FIG. 4 illustrates an example where each zone has a different number of sub-zones in a zone mapping based on the diversity scheme of FIG. 3C, according to an exemplary embodiment of the present invention. For example, when three zones exist in one frame, a zone 0 and a zone 1 are divided into 2 sub-zones, and a zone 2 has one sub-zone (i.e. the zone 2 is not divided into multiple sub-zones). This is because, for a special purpose (e.g. for data transmission for a mobile terminal), it is preferable to transmit service data for a continuous time period occupied by the corresponding zone, instead of dividing one zone into multiple sub-zones and scattering them in one frame period.

Figure 5:
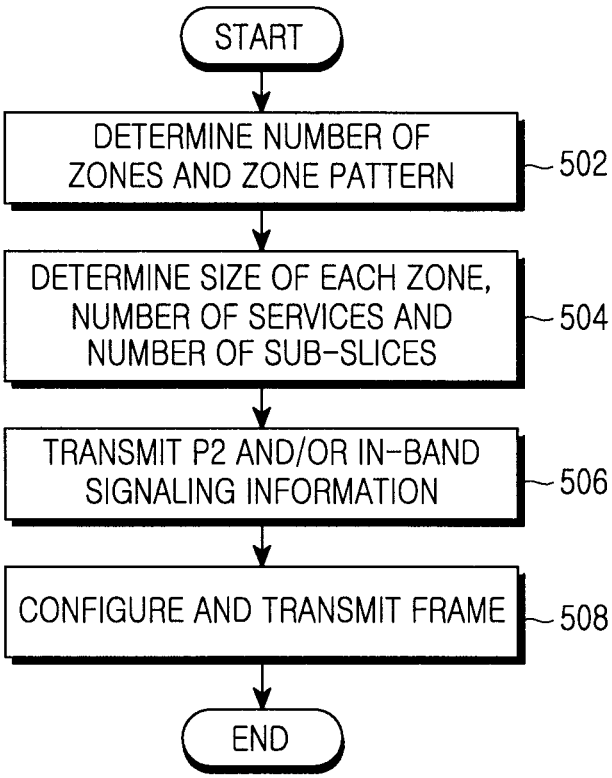
FIG. 5 is a diagram illustrating an operation in a transmitter according to an exemplary embodiment of the present invention.

FIG. 5 is a diagram illustrating an operation in a transmitter according to an exemplary embodiment of the present invention.

Referring to FIG. 5, the transmitter determines the number of zones and a zone arrangement scheme it will use in a corresponding frame in step 502. The zone arrangement indicates how multiple zones to be allocated in one frame will be physically mapped in the corresponding frame. In an exemplary implementation, the transmitter can notify whether the corresponding scheme is a TDM scheme or a diversity scheme, using a single bit for indication. If the number of zones is fixed (e.g. to 2) and the diversity scheme is used, step 502 can be omitted.

In step 504, the transmitter determines the size of areas that each zone occupies in the corresponding frame and detailed parameter values for each zone. That is, the transmitter determines the size of each zone, how many services are transmitted in each zone and into how many sub-slices each service should be sliced. Considering 2 zones and the diversity zone mapping scheme, the transmitter only needs to determine the number of sub-slices per service in each zone and the number of services for the first (or second) zone. The additional parameter values determined through steps 502 and 504 are configured in step 506 together with other control information (e.g. modulation for each service, coding rate, the number of Forward Error Correction (FEC) blocks, length of each sub-slice, start location, etc.) that should be included in P2, in order to be transmitted through P2 which is a separate control channel. The zone-related parameter values can be signaled together with the service traffic in the in-band form, and some or all of the number of zones, a zone mapping scheme, a size of each zone, the number of sub-slices per service for each zone, and the number of services included in a zone to which the service in reception belongs are included according to the signaling scheme. Finally, in step 508, the transmitter configures a frame using a control channel and a service channel and transmits it to a terminal.

Figure 6:
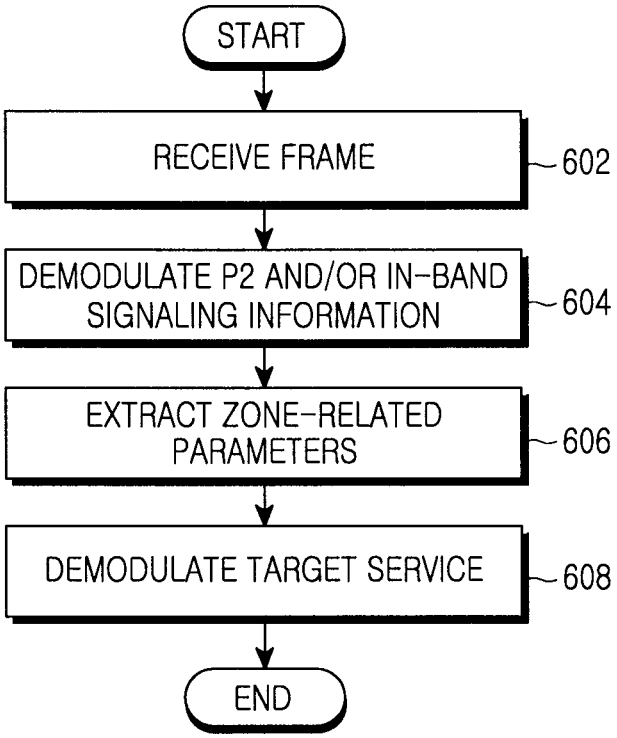
FIG. 6 is a diagram illustrating an operation in a receiver according to an exemplary embodiment of the present invention.

FIG. 6 is a diagram illustrating an operation in a receiver according to an exemplary embodiment of the present invention.

Referring to FIG. 6, when a terminal, or receiver, receives a frame in step 602, the receiver demodulates control information transmitted through P2 and/or in-band signaling in step 604. In step 606, the receiver extracts zone-related parameter values from the demodulated control information. For example, when 2 zones and the diversity zone mapping scheme are considered, the receiver is allowed to find out, from the P2 preamble, the number of sub-slices for each zone and the number of services included in the first (or second) zone. Based on the zone-related parameter values obtained in step 606, the receiver demodulates the target service in step 608, using a size of the zone in which the service is included that it wants in the corresponding frame, a location of the zone, and a distance between sub-slices belonging to the same service in the corresponding zone (i.e. the number of sub-slices, at intervals of which the service is transmitted, is determined according to the number of services and the number of sub-slices per service).

Figure 7:
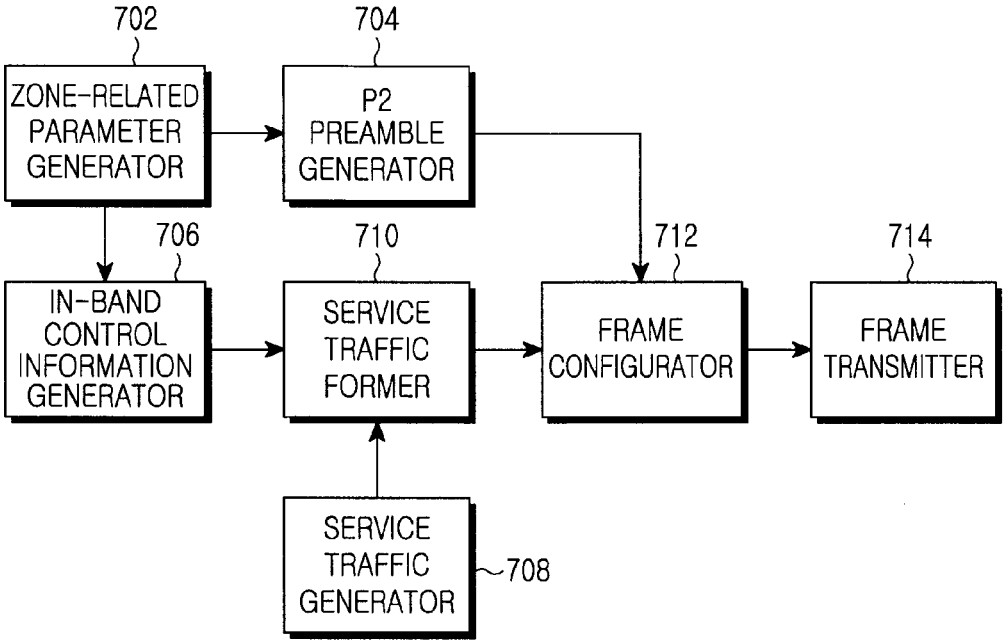
FIG. 7 is a diagram illustrating a transmitter according to an exemplary embodiment of the present invention.

FIG. 7 is a diagram illustrating a transmitter according to an exemplary embodiment of the present invention.

Referring to FIG. 7, using zone parameter values output from a zone-related parameter generator 702, a P2 preamble generator 704 and an in-band control information generator 706 generate relevant control information. A service traffic former 710 receives control information to be inserted in service traffic, generated from the in-band control information generator 706, and service traffic generated by means of a service traffic generator 708, and forms substantial service data using the received data. A frame configurator 712 configures data using a P2 preamble signal generated by the P2 preamble generator 704 and the service traffic generated by the service traffic former 710, allocates the data to one frame, and then transmits the corresponding frame through a frame transmitter 714.

Figure 8:
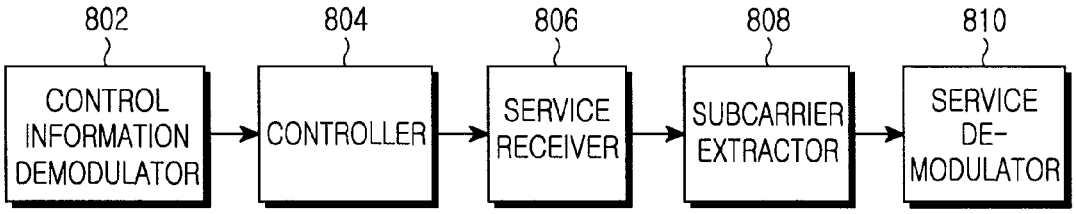
FIG. 8 is a diagram illustrating a receiver according to an exemplary embodiment of the present invention.

FIG. 8 is a diagram illustrating a receiver according to an exemplary embodiment of the present invention.

Before a description of the receiver is given, the frame configuration will be described once again. A frame consists of a P2 preamble and more than one service traffic. Since the P2 preamble transmits control information including scheduling information indicating at which location in the frame each service traffic is transmitted, it is located ahead of service data so that the terminal can demodulate the P2 preamble first. The service can be formed in units of sub-carriers, as opposed to units of OFDM symbols. In other words, assuming that one frame is composed of multiple OFDM symbols, each service included in the frame is formed in units of sub-carriers, not in units of symbols, allowing the maximum flexibility for a Transmission Time Interval (TTI) of the broadcast service transmitted in the corresponding frame.

Meanwhile, the control information can be transmitted together with the service data. In order to receive desired service traffic in the current preamble, it is necessary to acquire scheduling information for the corresponding service in advance. That makes it possible to obtain control information through demodulation for a target service transmitted through a previous frame of the current frame (i.e. it indicates in-band signaling).

The service data or in-band signaling is received through an undepicted receiver, and the received service data or in-band signaling is demodulated by means of a control information demodulator 802. A variety of control information necessary for demodulating services, including information on the number of services included in the first or second zone (i.e. one of two zones) and the number of sub-slices per service for each zone, acquired through the control information demodulator 802, is input to a controller 804.

The controller 804 determines the remaining parameter values necessary for finding out a location of a target service in the frame using the input control information. In other words, the controller 804 determines parameter values for a size of each zone and the number of services included in the first or second zone (one of the two zones), depending on the parameter values for the number of sub-slices per service for each zone and the number of services included in the first or second zone (the other one of the two zones), received from the control information demodulator 802. At this point, a zone arrangement pattern indicating whether the two zones will be alternately repeated can also be determined.

The controller 804 outputs all the output parameter values related to the location of the target service in the frame to a service receiver 806 along with other control information acquired by the control information demodulator 802. The service receiver 806 includes more than one received service traffic.

A sub-carrier extractor 808 reads, from the service receiver 806, data values of sub-carriers through which one or more sub-slices (when one service is not sliced into multiple sub-slices) are transmitted that constitute the desired target service. To this end, the sub-carrier extractor 808 finds out the correct service location for the target service using the parameter values output from the controller 804. For example, assume that when 20 services are transmitted through the corresponding frame and the number of services included in a zone 0 is 15, a service index of the target service is #10. Therefore, it can be appreciated that the target service belongs to the zone 0. Further, if the number of sub-slices per service for the zone 0 is 4, an interval between multiple sub-slices belonging to the target service becomes a value determined by dividing a size of the zone 0 by 4.

Therefore, the sub-carrier extractor 808 finds out a location of the first sub-slice in the corresponding frame and a length of its transmission period using scheduling information for a start location and a size of the first sub-slice of the target service, and determines start locations and sizes of the remaining sub-slices using an interval between sub-slices and sizes of the remaining zones. Since the number of sub-slices per service is 4, start locations of the remaining three sub-slices become values determined by adding an interval value between sub-slices at the start location of the first sub-slice once, twice and three times, respectively. For example, a start location of the third sub-slice becomes ('start location of first sub-slice'+'interval between sub-slices'*2).

Assuming that two zones are alternately repeated twice, it means that 2 sub-zones having a ½ size of each zone constitute each zone. Thus, in case of the zone 0, first two sub-slices of a target service are transmitted through the first sub-zone, and the remaining two sub-slices are transmitted through the second sub-zone. In addition, it can be understood that the first sub-zone of the zone 1 exists between the first sub-zone and the second sub-zone of the zone 0. Hence, a start location of the third sub-slice of the service belonging to the zone 0 should be determined considering the size of the sub-zone of the zone 1. That is, a start location of the third sub-slice becomes ('start location of the first sub-slice'+'interval between sub-slices'*2+(size of zone 1)/2).

The data values of the target service, output from the sub-carrier extractor 808, are input to a service demodulator 810. The service demodulator 810 may include a receiver structure of the common DVB-T2 system, including a time deinterleaver, a demodulator (receiver's processor corresponding to a QPSK and M-QAM modulator in the transmitter), and a channel decoder (receiver's processor corresponding to a channel encoder in the transmitter).

As is apparent from the foregoing description, exemplary embodiments of the present invention define zones based on the number of service slicings for the frame composed of a plurality of broadcast services transmitted using one RF, and efficiently perform physical mapping on the broadcast services included in the corresponding zones, thereby simultaneously supporting transmission/reception of the broadcast service data for both the fixed and mobile terminals.

As a result, exemplary embodiments of the present invention can reduce power consumption for the services for the mobile terminal, and acquire high time diversity gain for the services for the fixed terminal.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method for configuring broadcast service data in a digital broadcasting communication system, the method comprising:

mapping, in a frame, a first contiguous zone, corresponding to an entirety of broadcast service data of a first type in the frame, and a second contiguous zone, corresponding to an entirety of broadcast service data of a second type in the frame, wherein the broadcast service data included in the first contiguous zone and the second contiguous zone is sliced according to a number of service slicings allocated for each zone, wherein a number of service slicings for the first contiguous zone is different from a number of service slicings for the second contiguous zone, and wherein each of the first contiguous zone and the second contiguous zone is a contiguous area in the frame.

2. The method of claim 1, wherein the broadcast service data of the first type comprises broadcast service data for a mobile terminal, and the broadcast service data of the second type comprises broadcast service data for a fixed terminal.

3. The method of claim 1, wherein the broadcast service data is sliced into sub-slices corresponding to the number of service slicings allocated for each zone.

4. The method of claim 3, wherein an interval between the sub-slices belonging to the same broadcast service in each zone is as long as possible in each zone.

5. The method of claim 1, wherein the number of service slicings for the first contiguous zone is less than the number of service slicings for the second contiguous zone.

6. The method of claim 1, wherein the first contiguous zone and the second contiguous zone are mapped in the frame using a Time Division Multiplexing (TDM) scheme in which each zone is continuously allocated in a time domain.

7. The method of claim 1, wherein the first contiguous zone and the second contiguous zone are mapped in the frame such that each zone is scattered in a time domain in a distributed manner.

8. The method of claim 1, wherein the broadcast service data included in the first contiguous zone and the second contiguous zone is sliced into contiguous sub-slices according to the number of service slicings allocated for each zone.

9. A method for transmitting broadcast service data in a digital broadcasting communication system, the method comprising:

mapping, in a frame, a first contiguous zone, corresponding to an entirety of broadcast service data of a first type, and a second contiguous zone corresponding to an entirety of broadcast service data of a second type in the frame; and transmitting the frame, wherein the broadcast service data included in the first contiguous zone and the second contiguous zone is sliced according to a number of service slicings allocated for each zone, wherein a number of service slicings for the first contiguous zone is different from a number of service slicings for the second contiguous zone, and wherein each of the first contiguous zone and the second contiguous zone is a contiguous area in the frame.

10. The method of claim 9, wherein the broadcast service data of the first type comprises broadcast service data for a mobile terminal, and the broadcast service data of the second type comprises broadcast service data for a fixed terminal.

11. The method of claim 9, wherein the broadcast service data is sliced into sub-slices corresponding to the number of service slicings allocated for each zone.

12. The method of claim 11, wherein an interval between the sub-slices belonging to the same broadcast service in each zone is as long as possible in each zone.

13. The method of claim 9, wherein the number of service slicings for the first contiguous zone is less than the number of service slicings for the second contiguous zone.

14. The method of claim 9, wherein the first contiguous zone and the second contiguous zone are mapped in the frame using a Time Division Multiplexing (TDM) scheme in which each zone is continuously allocated in a time domain.

15. The method of claim 9, wherein the first contiguous zone and the second contiguous zone are mapped in the frame such that each zone is scattered in a time domain in a distributed manner.

16. The method of claim 9, wherein the broadcast service data included in the first contiguous zone and the second contiguous zone is sliced into contiguous sub-slices according to the number of service slicings allocated for each zone.

17. A method for receiving broadcast service data in a digital broadcasting communication system, the method comprising:

receiving a frame in which broadcast service data is included, wherein a first contiguous zone, corresponding to an entirety of broadcast service data of a first type in the frame, and a second contiguous zone, corresponding an entirety of to broadcast service data of a second type in the frame, are mapped in the frame, and further wherein the broadcast service data included in the first contiguous zone and the second contiguous zone is sliced according to a number of service slicings allocated for each zone, and wherein a number of service slicings for the first contiguous zone is different from a number of service slicings for the second contiguous zone, and wherein each of the first contiguous zone and the second contiguous zone is a contiguous area in the frame.

18. The method of claim 17, wherein the broadcast service data of the first type comprises broadcast service data for a mobile terminal, and the broadcast service data of the second type comprises broadcast service data for a fixed terminal.

19. The method of claim 17, wherein the broadcast service data is sliced into sub-slices corresponding to the number of service slicings for each zone.

20. The method of claim 19, wherein an interval between the sub-slices belonging to the same broadcast service in each zone is as long as possible in each zone.

21. The method of claim 17, wherein the number of service slicings for the first contiguous zone is less than the number of service slicings allocated for the second contiguous zone.

22. The method of claim 17, wherein the first contiguous zone and the second contiguous zone are mapped in the frame using a Time Division Multiplexing (TDM) scheme in which each zone is continuously allocated in a time domain.

23. The method of claim 17, wherein the first contiguous zone and the contiguous second zone are mapped in the frame such that each zone is scattered in a time domain in a distributed manner.

24. The method of claim 17, wherein the broadcast service data included in the first contiguous zone and the second contiguous zone is sliced into contiguous sub-slices according to the number of service slicings allocated for each zone.

25. An apparatus for transmitting broadcast service data in a digital broadcasting communication system, the apparatus comprising:

a frame configurator for configuring a frame by mapping, in the frame, a first contiguous zone, corresponding to an entirety of broadcast service data of a first type in the frame, and a second contiguous zone, corresponding to an entirety of broadcast service data of a second type in the frame; and a frame transmitter for transmitting the frame that has been configured, wherein the broadcast service data included in the first contiguous zone and the second contiguous zone is sliced according to a number of service slicings allocated for each zone, wherein a number of service slicings for the first contiguous zone is different from a number of service slicings for the second contiguous zone, and wherein each of the first contiguous zone and the second contiguous zone is a contiguous area in the frame.

26. The apparatus of claim 25, wherein the broadcast service data of the first type comprises broadcast service data for a mobile terminal, and the broadcast service data of the second type comprises broadcast service data for a fixed terminal.

27. The apparatus of claim 25, wherein the broadcast service data is sliced into sub-slices corresponding to the number of service slicings allocated for each zone.

28. The apparatus of claim 27, wherein an interval between the sub-slices belonging to the same broadcast service in each zone is as long as possible in each zone.

29. The apparatus of claim 25, wherein the number of service slicings for the first contiguous zone is less than the number of service slicings for the second contiguous zone.

30. The apparatus of claim 25, wherein the first contiguous zone and the second contiguous zone are mapped in the frame using a Time Division Multiplexing (TDM) scheme in which each zone is continuously allocated in a time domain.

31. The apparatus of claim 25, wherein the first contiguous zone and the second contiguous zone are mapped in the frame such that each zone is scattered in a time domain in a distributed manner.

32. The met apparatus of claim 25, wherein the broadcast service data included in the first contiguous zone and the second contiguous zone is sliced into contiguous sub-slices according to the number of service slicings allocated for each zone.

33. An apparatus for receiving broadcast service data in a digital broadcasting communication system, the apparatus comprising:

a receiver for receiving a frame including the broadcast service data and for demodulating the received frame, wherein a first contiguous zone, corresponding to an entirety of broadcast service data of a first type in the frame, and a second contiguous zone, corresponding to an entirety of broadcast service data of a second type in the frame, are mapped to be an entirety of the frame and further wherein the broadcast service data included in the first contiguous zone and the second contiguous zone is sliced according to a number of service slicings allocated for each zone, wherein a number of service slicings for the first contiguous zone is different from a number of service slicings for the second contiguous zone, and wherein each of the first contiguous zone and the second contiguous zone is a contiguous area in the frame.

34. The apparatus of claim 33, wherein the broadcast service data of the first type comprises broadcast service data for a mobile terminal, and the broadcast service data of the second type comprises broadcast service data for a fixed terminal.

35. The apparatus of claim 33, wherein the broadcast service data is sliced into sub-slices corresponding to the number of service slicings allocated for each zone.

36. The apparatus of claim 35, wherein an interval between the sub-slices belonging to the same broadcast service in each zone is as long as possible in each zone.

37. The apparatus of claim 33, wherein the number of service slicings for the first contiguous zone is less than the number of service slicings for the second contiguous zone.

38. The apparatus of claim 33, wherein the first contiguous zone and the second contiguous zone are mapped in the frame using a Time Division Multiplexing (TDM) scheme in which each zone is continuously allocated in a time domain.

39. The apparatus of claim 33, wherein the first contiguous zone and the second contiguous zone are mapped in the frame such that each zone is scattered in a time domain in a distributed manner.

40. The apparatus of claim 33, wherein the broadcast service data included in the first contiguous zone and the second contiguous zone is sliced into contiguous sub-slices according to the number of service slicings allocated for each zone.

* * * * *